US006945739B1

(12) United States Patent
Putman

(10) Patent No.: US 6,945,739 B1
(45) Date of Patent: Sep. 20, 2005

(54) APPARATUS AND METHOD FOR SIMULTANEOUS IN-GROUND INSTALLATION OF SILT FENCE WITH WIRE MESH SUPPORT

(76) Inventor: Jessie Putman, 23357 U.S. Highway 411, Ashville, AL (US) 35953

( * ) Notice: Subject to any disclaimer, the term of this patent is extended or adjusted under 35 U.S.C. 154(b) by 0 days.

(21) Appl. No.: 10/886,473

(22) Filed: Jul. 7, 2004

(51) Int. Cl.[7] ..... E02B 7/02; E01F 7/02
(52) U.S. Cl. ..... 405/302.7; 405/302.6; 405/15
(58) Field of Search ..... 405/302.7, 302.6, 405/15

(56) References Cited

U.S. PATENT DOCUMENTS 4,705,427 A * 11/1987 Atkins et al. ..... 405/36
5,039,250 A * 8/1991 Janz ..... 405/15
5,915,878 A 6/1999 Carpenter
6,158,923 A 12/2000 Wheeler et al.
6,551,031 B2 4/2003 Van Ornum
6,796,747 B1 * 9/2004 Vreeland ..... 405/302.7
2002/0192029 A1 12/2002 Vreeland

* cited by examiner

*Primary Examiner*—Frederick L. Lagman
(74) *Attorney, Agent, or Firm*—Bradley, Arant, Rose & White

(57) ABSTRACT

This invention relates generally to the simultaneous in-ground anchoring of silt fence erosion barriers and wire mesh fencing, that includes a machine comprising a device for disrupting soil to create a trench, a device that simultaneously inserts portions of the silt fence and the wire mesh fencing into the trench and a device for backfilling the trench over the portions of the silt fence and wire mesh fencing that have been inserted in the trench so as to anchor the above-ground remainder of the silt fence and wire mesh fencing.

33 Claims, 5 Drawing Sheets

APPARATUS AND METHOD FOR SIMULTANEOUS IN-GROUND INSTALLATION OF SILT FENCE WITH WIRE MESH SUPPORT

FIELD OF THE INVENTION

The invention pertains to earth working equipment, more particularly to a machine comprising a soil disrupter for slicing a thin trench in soil, an apparatus for simultaneously inserting silt fencing and wire mesh backing to support the silt fencing and to anchor the silt fencing into the soil in a proper position, and an apparatus for backfilling soil into such trench to secure the silt fencing with wire backing and anchor in the proper position.

BACKGROUND OF THE INVENTION

In the construction field, silt fence is a synthetic material, about the weight of canvas and typically 60 inches wide, installed around construction sites, disturbed areas, and in ditches to retain silt while allowing water to slowly pass through. Approximately 45 inches to 54 inches remain above the ground supported by posts, and the balance is buried in the ground to prevent soil and debris from escaping under the silt fencing. Most installation procedures follow engineering specifications calling for a trench 12 inches deep and 6 inches wide with a lap of silt fence covering the bottom of the trench to be covered and compacted with soil.

Erosion control, including silt fence, is mandated on all federal projects and on many urban projects, both public and private. Millions of feet are installed each year. Traditionally, the silt fence has been installed with support for its vertical position provided only through rigid support stakes set into the ground at varying intervals. This traditional method of installation without the presence of continuous vertical support between stakes often results in the failure of the silt fence to maintain its integrity. A breach in the integrity of the silt fence allows silt to flow over, under, or through the fence resulting in a failure of the silt barrier. Increasingly, administrative agencies and private entities responsible for construction projects, whose nature demands silt fencing, are requiring that the flexible silt fences be supported by rigid backing as support between stakes as a way to maintain the silt fence more securely in a vertical position and thus to prevent breaches of the silt barrier.

Furthermore, the traditional method of installation of silt fencing relies almost exclusively upon the compaction of soil around the subsurface portion of the silt fencing to anchor the silt fence in place. Due to poor compaction methods employed, silt fences installed in this traditional manner can become easily unanchored, especially during large rainwater events. Thus, this traditional method of anchoring often results in breaches of the integrity of the base of silt fence. Increasingly, administrative agencies and private entities responsible for construction projects whose nature demands silt fencing are requiring that improved methods for anchoring the silt fencing be employed to more securely affix the silt fence and better protect it against erosion and resulting gaps at the bottom.

Contractors from all over the country, hands-on people and large companies knowledgeable in the art and part of the industry, have attempted to build a machine that installs silt fencing efficiently and effectively. None have designed a means to simultaneously install a rigid wire mesh backing that will provide the horizontal and vertical benefits desired. Currently, most contractors use a trenching machine to dig and excavate a 150 mm deep trench, after which they pound in steel posts, insert wire mesh into the trench and then attach fabric to the wire in the open trench. The wire/fabric combination is then uprighted and held in place by posts with a short lip of the fabric/mesh combination on the bottom of the trench for soil to rest on. The trench is then manually backfilled by pushing the excavated soil into the open trench with a blade on their machine.

There exists one design of a machine invention disclosed in the Carpenter patent (U.S. Pat. No. 5,915,878), whereby silt fencing in installed with a rope anchor in a trench sliced by the same invention, but it does not teach the simultaneous incorporation of the wire mesh support member in its installation claims and has a number of important design differences. Carpenter does not teach or contemplate the simultaneous installation of a relatively rigid backing member, including the wire mesh of the present application, and thus it fails to address the problem of support for silt fencing that is now being demanded and/or required. Furthermore, Carpenter specifically requires that large holes be drilled in its wheel, used to insert silt fencing into a trench, as a means to avoid bunching or gathering of the silt fence material during installation, whereas the introduction of the wire mesh backing in the present application configures the silt fence fabric to avoid drilling holes that could compromise the structural integrity of the wheel. The presence of holes in the wheel of the present application could cause the wire mesh to become entangled with the wheel and pull the wire mesh out of the ground. Carpenter also requires the use of static panels as a means to guide the silt fencing fabric to its proper position for insertion by the wheel in that invention. Carpenter also employs static panels to hold the soil that has been sliced back while its wheel rolls the fabric in the ground, then allowing the soil to collapse back against the fabric after it passes by the panels. These panels will not work with the wire mesh in the present application because the panels would cause the wire to bunch up and become entangled with the panels instead of flowing through them. Again, the introduction of the wire mesh backing in the present application configures the silt fence fabric to avoid the need for panels or other guides for the fencing during installation. Furthermore, the incorporation of crimped wire mesh into the subterranean fold of the silt fencing in the present application provides far stronger anchoring qualities than the rope anchor taught by Carpenter. Finally, the foot member in the present application automates the compaction of soil displaced through installation of the silt fencing, an element and process that is not taught in Carpenter. Many other examples of the prior art are referenced in the Carpenter patent.

Thus, the present application improves on the prior art by automating and mechanizing the simultaneous installation of a rigid support member for silt fencing, by providing superior anchoring for the silt fencing once installed and by automating and mechanizing the compaction of disturbed soil after installation of the silt fencing. These enhancements over the prior art reduce labor costs and improve the structural integrity of silt fencing, presenting a cost benefit to consumers and the public, as well as a reduction in silt pollution to the environment.

SUMMARY OF THE INVENTION

The invention mechanizes a part of the above operation with a device attached to the back of a tractor or other motive force which simultaneously does several things. First a plow head or other soil disturber ("plow head") trenches a line, and two spools synchronized with the speed of the motive force respectively lay down wire mesh and silt fencing fabric above the trench. In-line with the plow head and behind it is a strong generally circular rigid plate (steel is a good choice) which rolls over the wire/fabric, pushes the wire and fabric into the disrupted soil or trench and crimps the wire and fabric so that it is seated in the "V" of the disrupted soil or trench. Just behind and offset slightly on one side of the circular plate is a backfill "foot" which pushes the just-plowed dirt back into the trench substantially covering the crimped wire and fabric. After this mechanized operation is completed, the main body of the wire and fabric is brought upright and held in that position by posts set at appropriate intervals along the line where the trenching has been done. The wire is clipped to the posts and the fabric to the wire.

Because the silt fencing material is of a lighter weight and more flexible than the wire mesh, once the machine of the invention begins to move and pull upon the silt fence material, there may be a tendency for the roll of material to rotate on its spool more rapidly than it is being embedded into the ground by virtue of inertial rotation. To retard such possible inertial "over-rolling," an encumbrance of some kind may be desirable. Such an encumbrance could be an automatic or manual brake applied to the roll of silt fence material, or more simply, just a weight draped across the roll of silt fence material, such as a relatively heavy chain anchored to the frame at one end and with the loose end extending across the roll of silt fence material in the direction of rotation of the roll.

In order to be sure the correct depth has been achieved, one or more depth markers (such as a circle or concentric circles) have been placed onto the center of the circular plate generally up to 6 inches from its perimeter so that it is easy to see visually whether the desired depth of the trench has been consistently achieved, with the ability to vary the depth to greater than 6 inches (usually the minimum required depth) depending on the situation.

Because silt fencing can be attached to the wire mesh after the latter has been affixed to its support stakes, the simultaneous layering of the wire mesh or other support member and the silt fence during installation of the silt fence fabric would improve the speed of the complete installation of the fully supported fence and contributes to superior anchoring of the silt fence material into the ground. An improvement in the speed of installation would reduce costs to the public who are both taxpayers and consumers. Furthermore, the improvement in quality of the integrity of the traditional silt fence would reduce erosion and the resulting damage to our environment.

The integration of the wire mesh and fabric as an anchor in the crimped fold between the silt fence and the wire mesh backing will also improve the integrity of the installed fence and would eliminate reinstallation of silt fencing following a breach in the silt fencing material. The elimination of the labor costs associated with reinstallation of the silt fence would further reduce costs. Furthermore, the improvement in the integrity of the traditional silt fence would reduce erosion and the resulting damage to the environment.

BRIEF DESCRIPTION OF THE DRAWINGS

These and other features, aspects, structures, advantages, and functions are shown or are inherent in, and will become better understood with regard to, the following description and accompanied drawings where.

DETAILED DESCRIPTION OF THE PREFERRED EMBODIMENT

Figure 1:
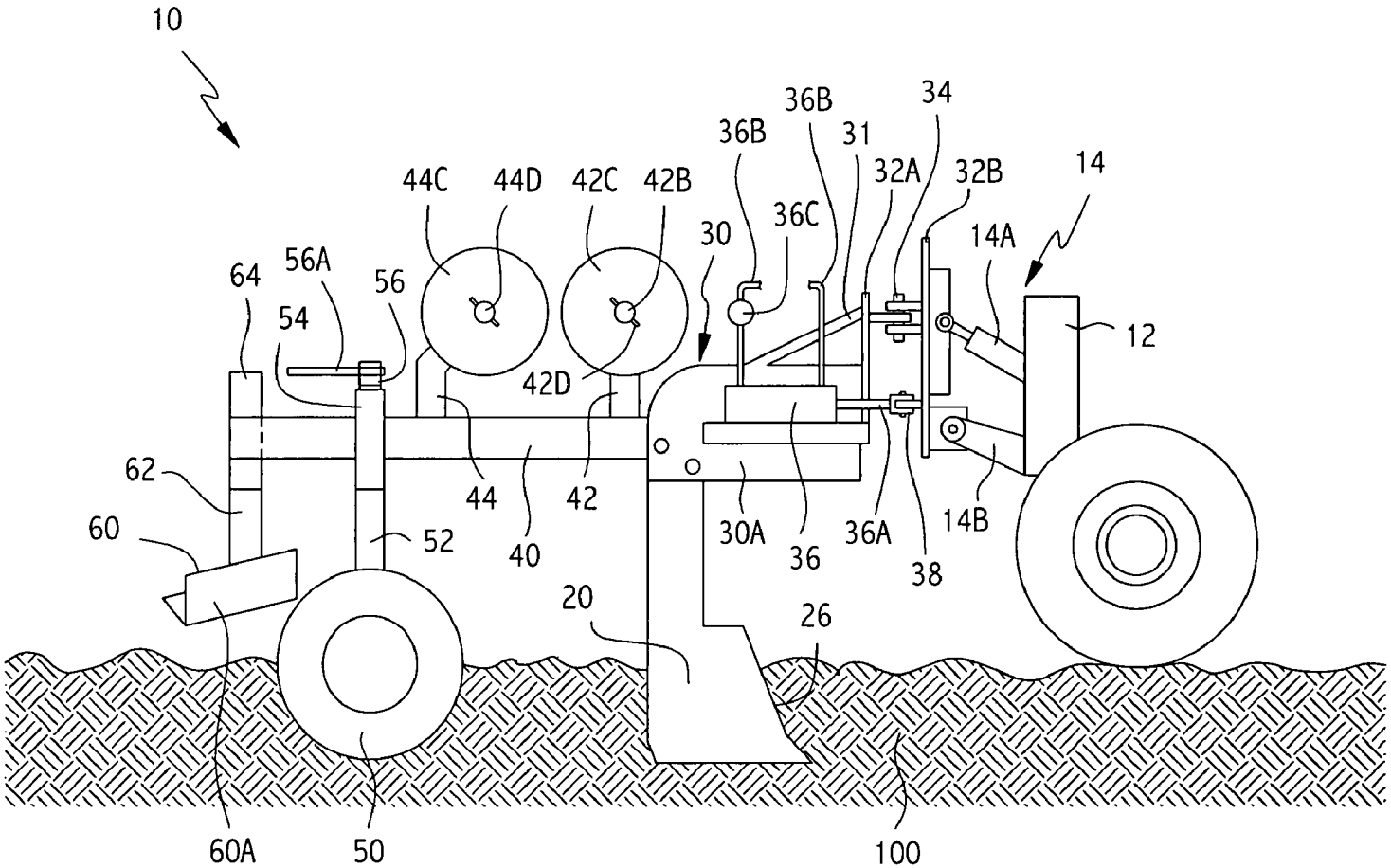
FIG. 1 is the right side view of the machine attached to the towing vehicle or other motive force.

Referring now more particularly to the drawings, wherein like reference numerals designate identical or corresponding parts throughout the several figures, FIG. 1 shows the silt fence machine 10 attached to a towing vehicle 12 via a conventional three-point hitch 14, the top link being a conventional hydraulic cylinder 14A, and the lower arms 14B. The cylinder 14A directly acts to alter the angle of attack of a soil disrupter 20 for faster penetration into the soil 100 and to allow the silt fence machine 10 to adjust to the contours of the terrain of soil 100, and the lower arms 14B adjust the depth of the silt fence machine 10 approximately 4 inches to 14 inches during operation. The silt fence machine 10 will operate with a standard top link, but without the speed of penetration into the soil, and can be adapted to operate with other power sources also.

Figure 2:
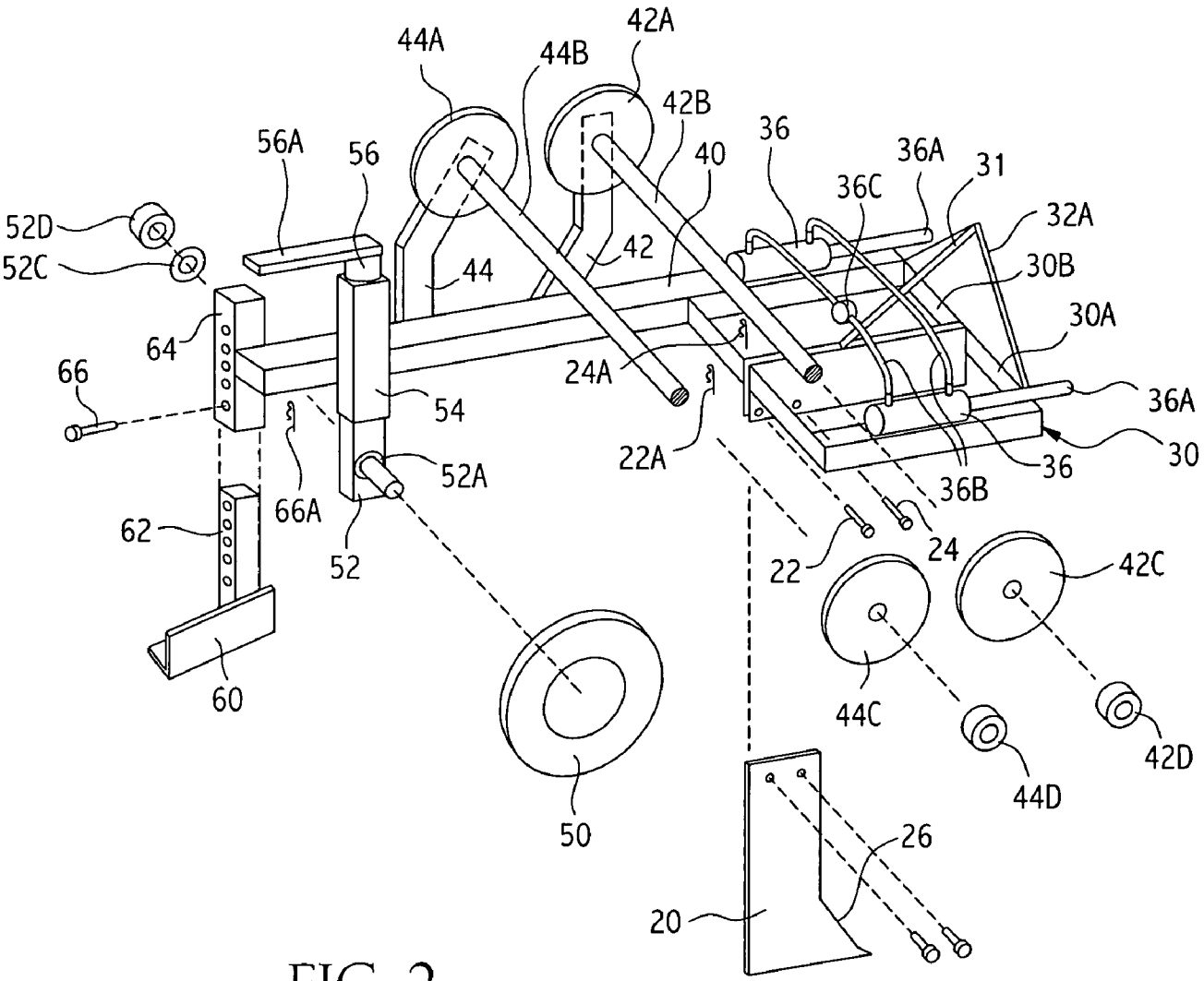
FIG. 2 is the exploded right side perspective view of the machine.
Figure 3:
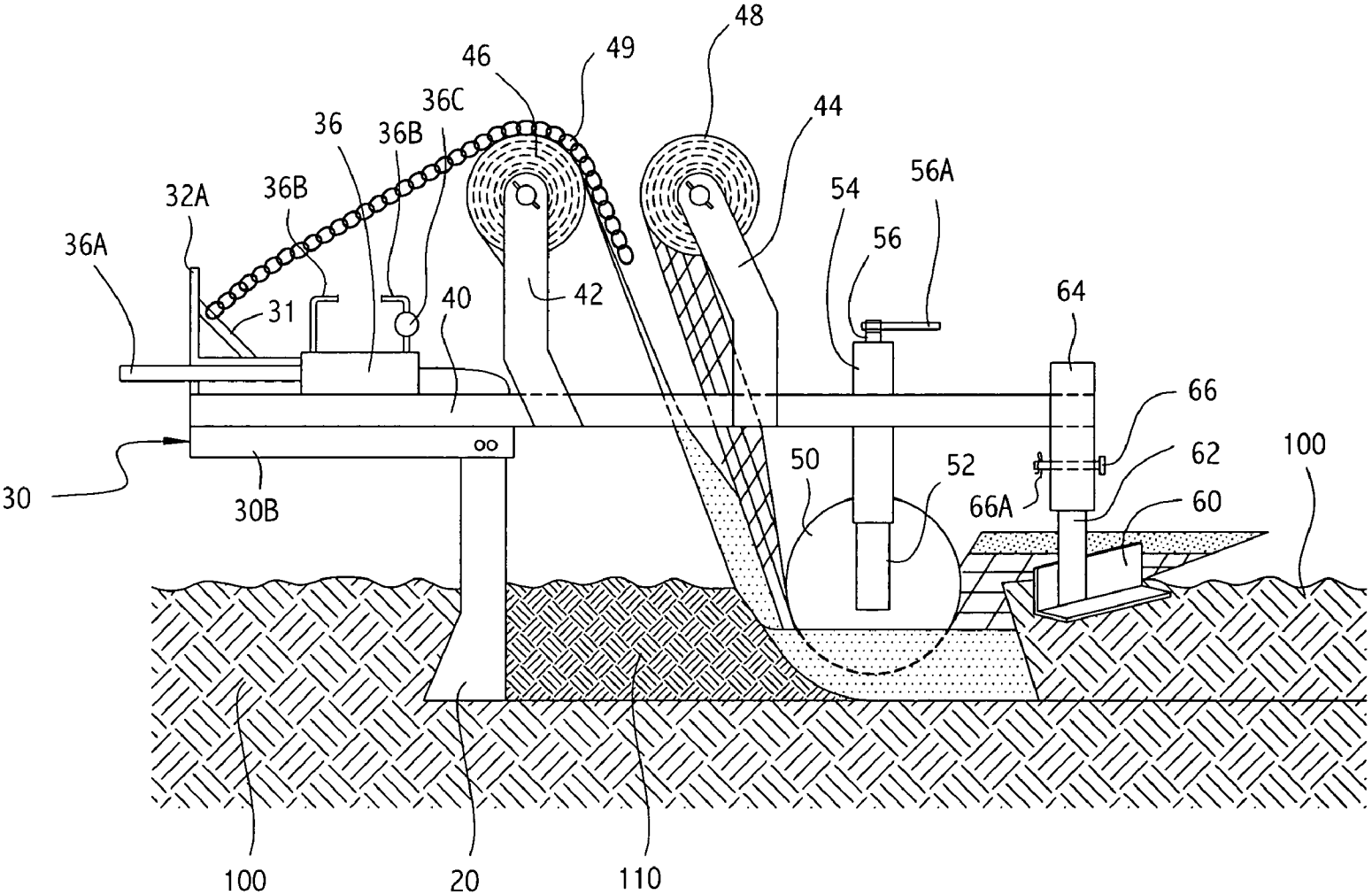
FIG. 3 is the left side view of the machine with silt fence material (shaded) and the wire mesh (grid) being inserted in the vertical trench by the circular rigid plate.
Figure 4:
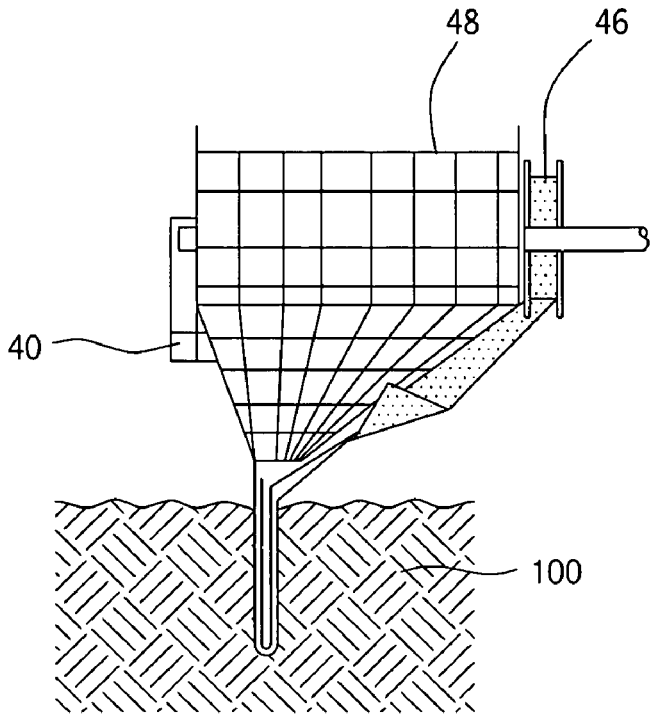
FIG. 4 is the rear view of the invention as it would operate installing the silt fence with wire mesh backing in the ground by means of the rigid plate wheel crimping the wire mesh on top of the silt fence in the trench being sliced in advance of the wheel.

The silt fence machine 10 includes a frame 30, FIGS. 1, 2, and 3, comprising a C-channel frame 30A and a partial C-channel frame 30B, FIG. 2, affixed together in a rigid manner with the soil disruptor 20 sandwiched between the two frames. The two frames 30A and 30B are welded to vertical plate 32A which is attached by swiveling spindle 34 and hydraulic pistons 36 to a second vertical plate 32B that is then connected to the conventional three-point hitch 14. The swiveling spindle 34 and hydraulic pistons 36 between the two vertical plates 32A and 32B allow for easier navigation and maneuverability through turns by towing vehicle 10. The top of vertical plate 32A is supported by diagonal brace 31.

The hydraulic pistons 36 are affixed in a rigid manner atop frames 30A and 30B. The piston arms 36A of hydraulic pistons 36 are affixed to vertical plate 32B by swiveling spindles 38. The hydraulic pistons 36 are not affixed to power source 12 or any other power source. Rather, hydraulic fluid lines 36B allow the transfer of hydraulic fluid between the hydraulic pistons 36 during operation of the silt fence machine 10 in order to allow the silt fence machine 10 to articulate around swiveling spindles 34 and 38. When the silt fence machine 10 is not in operation, hydraulic line valve 36C is closed thereby preventing the transfer of hydraulic fluid through hydraulic fluid lines 36B and preventing silt fence machine 10 from articulating around swiveling spindles 34 and 38.

Rigid forms, which in a preferred embodiment are tubular steel, comprise support structure 40 that also functions as one side of the partial C-channel frame 30B, FIGS. 1, 2, 3, and 4. Support structure 40 is rigidly attached to the front and rear left side of partial C-channel frame 30B extending rearwardly beyond frame 30. Support structure 40 supports vertical support members 42 and 44 affixed, as by welding, perpendicular to said support structure 40. Welded to support member 42 is an elongated member, such as a length of standard pipe or solid cold roll finish bar (pipe) 42B, that extends perpendicular to vertical support member 42 and horizontal to the ground 100. Pipe 42B holds a roll of silt fence material 46, which is bracketed by circular plate 42A. Circular plate 42A has a hole drilled through its center axis so as to fit over pipe 42. Circular plate 42A is mounted onto pipe 42 by fitting pipe 42 through the center axis hole in circular plate 42A, and circular plate 42A can be adjusted to its desired position along pipe 42B and then locked into place. The roll of silt fence material 46 is positioned top first on pipe 42B, and circular plate 42A positions the bottom edge of the silt fence material 46 approximately 4 inches to 8 inches perpendicularly from the plane of wheel 50.

Welded to support member 44 is an elongated member, such as a length of standard pipe or solid cold roll finish bar (pipe) 44B, that extends perpendicular to vertical support member 44 and horizontal to the ground 100. Pipe 44B holds a roll of wire mesh fencing 48, preferably 14 gauge or larger, which is bracketed by circular metal plate 44A. Circular plate 44A has a hole drilled through its center axis so as to fit over pipe 44. Circular plate 44A is mounted onto pipe 44 by fitting pipe 44 through the center axis hole in circular plate 44A, and circular plate 44A can be adjusted to its desired position along pipe 44B and then locked into place. The roll of wire mesh fencing 48 is positioned bottom first on pipe 44B, and circular plate 44A positions the bottom edge of the wire mesh fencing 48 approximately 4 inches to 8 inches perpendicularly from the plane of wheel 50.

Circular metal plates 42C and 44C have holes drilled through their center axis so as to fit over pipes 42B and 44B, respectively, to hold the rolls of silt fence material 46 and wire mesh fencing 48 in their desired horizontal positions on pipes 42B and 44B. Pipe collars 42D and 44D are then fitted onto pipes 42B and 44B, respectively, to lock circular pates 42C and 44C so as to hold silt fence material 46 and wire mesh backing 48 into their respective horizontal positions.

Figure 5A:
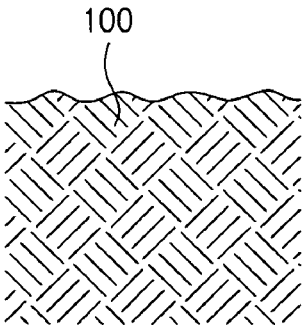
FIGS. 5A–C shows a partial cross section conceptual view of the soil (a) before the operation of the machine, (b) during operation of the machine, and (c) after the operation of the machine with the silt fence and wire mesh backing installed and the soil trench compacted around it.

Silt fence material 46 and wire mesh backing 48 are converted to a vertical position by wheel 50 engaging the horizontal silt fence material 46 and wire mesh fencing 48 perpendicularly as they roll downward and away from the towing vehicle or motive force 12, thus causing the silt fence material 46 and wire mesh backing 48 to fold into two flaps as they flow beneath and pivot against wheel 50 (FIG. 3). The horizontal positions of the silt fence material 46 and wire mesh fencing 48 on support structures 42 and 44, respectively, determine the size of the flaps of the stilt fence material 46 and wire mesh fencing 48, and thus the height of the silt fence material 46 and wire mesh backing 48 above the fold, with the goal being one flap of the fold at least 4 inches long positioned below the surface of soil 100, with the balance of the width of the silt fence material 46 and wire mesh fencing 48 on the other flap, positioned partially below the surface of soil 100 for the depth of the trench and the remainder above the surface of soil 100, FIGS. 3, 4, and 5.

FIG. 3 illustrates a weight 49, such as a heavy chain, affixed to vertical brace 31 that extends over the roll of silt fence material 46 and onto the unrolling silt fence material 46 before its contact with the unrolling wire mesh backing 48. The weight 49 is employed to maintain tension on silt fence material 46 as it is dispensed from the roll of silt fence material 46 mounted on pipe 42B and to arrest the speed of silt fence material 46 as it is dispensed from the roll of silt fence material 46 mounted on pipe 42B to ensure that silt fence material 46 and wire mesh backing 48 are dispensed at the same rate.

FIG. 2 details cotter pin 22 and locking wire fastener 22A securing soil disrupter 20 in frame 30, and cotter pin 24 and locking wire fastener pin 24A securing same and also acting as a sheer bolt for soil disrupter 20. Soil disruptor 20 is a rigid plate of hardened metal, preferably steel, approximately four (4) centimeters thick, presenting a forward edge 26, FIGS. 1 and 2, and a predetermined angle of attack, approximately 15 degrees to 40 degrees.

Wheel 50, FIGS. 1–3 and 6, attaches to the inside of static support arm 52 via a bearing and shaft assembly 52A allowing silt fence material 46 and wire mesh fencing 48 to flow by without snagging. Wheel 50 is a solid piece of material, preferably steel. The bearing shaft assembly 52A allows the wheel 50 to extend out approximately 4 inches from the support arm 52. The flange end on the bearing shaft assembly 52A is welded on to the support arm 52. The end of the bearing assembly 52A opposite the flange end is welded onto the wheel 50.

Support arm 52 is fastened inside of housing 54. Housing 54 is constructed of a strong rigid material (such as steel), and further houses ratchet mechanism 56 for the adjustment of the vertical depth of wheel 50. The adjustment of the depth of wheel 50 is controlled by manual manipulation of ratchet arm 56A. Housing 54 is welded to the right (inside) side of support structure 40.

Foot 60, FIGS. 1–3, attaches to the inside and below support arm 62. Foot 60 is a strong rigid piece (typically made of hardened metal) with a single 90° channel running the length of foot 60. Foot 60 is affixed in a rigid manner to the bottom end of support arm 62, with its forward face 60A offset away from the vertical plane of the side of wheel 50. Support arm 62 is drilled with large holes along its length to allow for adjustment of the depth of the operation of foot 60. Support arm 62 is housed inside of sleeve 64. Sleeve 64 is constructed of rectangular tubular steel. Sleeve 64 is also drilled along its length with holes at intervals corresponding to those drilled through support arm 62. Holes drilled in support arm 62 and sleeve 64 accept cotter pin 66 to affix the operational depth of foot 60. Cotter pin 66 is secured upon exit through the forward facing holes in sleeve 64 by wire fastening pin 66A.

Pertaining to the operation of silt fence machine 10, FIGS. 3, 4, and 5A–5C, the leading edge of silt fence material 46, held by support member 42 and standard pipe 42B, is affixed to the leading edge of wire mesh backing 48, held by support member 44 and standard pipe 44B. The silt fence material 46 and wire mesh backing 48 are threaded around and under vertical wheel 50. As silt fence machine 10 moves forward, soil disrupter 20 engages soil 100 and pulls silt fence machine 10 into soil 100. Soil disruptor 20 slices through soil 100 minimally disrupting soil 100 upward and minimizing horizontal compaction of soil 100 so as to create a narrow trench 110 in soil 100.

Figure 5B:
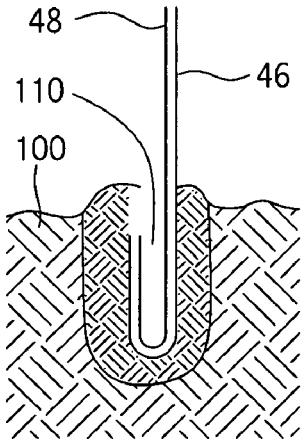
Figure 5C:
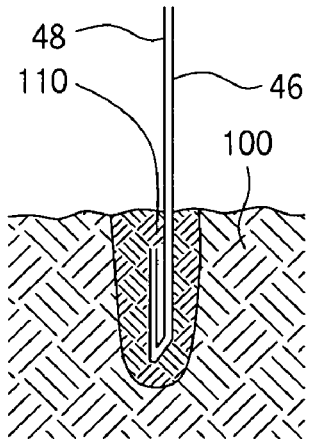
Figure 6:
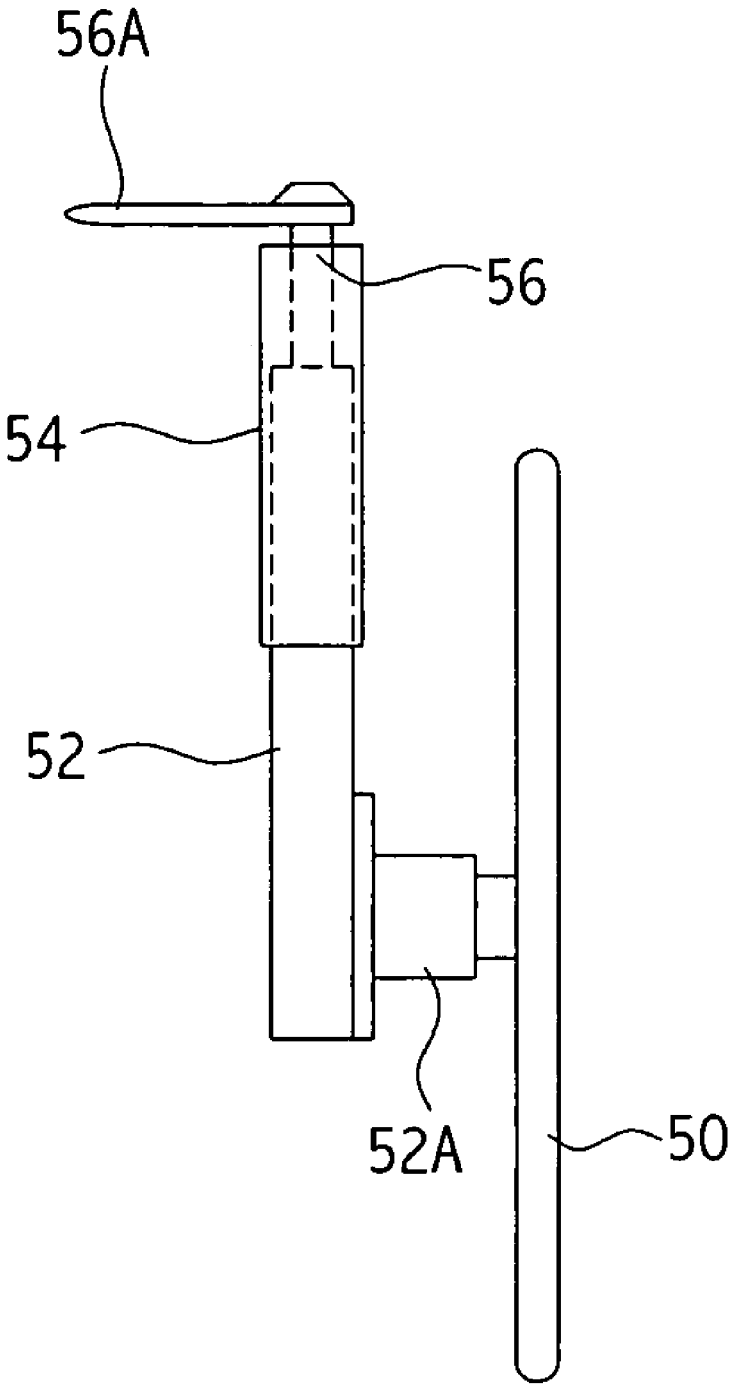
FIG. 6 is the rear view of the crimping wheel of the machine illustrating the bearing and shaft assembly for the wheel.

As silt fence machine 10 levels off, vertical wheel 50 engages silt fence material 46 and wire mesh backing 48 and begins to rotate, and silt fence material 46 and wire mesh backing 48 are funneled to wheel 50 and inserted by wheel 50 into trench 110 in soil 100. Wheel 50 crimps the wire mesh backing 48 on top of silt fence material 46 into trench 110 in soil 100 being formed by soil disrupter 20, creating flaps of silt fence material 46 and wire mesh backing 48 of unequal proportion (FIGS. 3, 5B). The vertical components of the unequal flaps of silt fence material 46 and wire mesh 48 are then secured in soil 100 by foot 60 compacting trench 110 created by soil disrupter 20 against the flaps of silt fencing 46 and wire mesh backing 48 as the silt fence machine 10 progresses forward (FIGS. 3, 5C). The V-shape created when wheel 50 crimps the wire fence backing 46 on top of silt fence material 48 into the trench created by soil disruptor 20 acts as an anchor as soil 100 is collapsed around it by the operation of foot 60 compressing the soil in the created trench 110 (FIGS. 3, 5C). Compaction of soil 100 around the V-shape is demonstrated in FIGS. 5A–C and effectively locks silt fence material 46 and wire mesh backing 48 into soil 100.

Obviously, many modifications and variations of the present invention are possible in light of the above teachings. It is, therefore, to be understood that, within the scope of the pending claims, the invention may be practiced other than as specifically described. To the extent other embodiments are herein created, it is intended that they fall within the scope and protection provided by the claims appended hereto.

What is claimed is:

1. A silt fence machine attachable to a motive force, comprising a soil disrupter for trenching through soil, a support structure for silt fence material and wire mesh synchronizable with the speed of the motive force to dispense said fence material and wire mesh simultaneously in overlapping layers behind said soil disrupter and a wheel for inserting said silt fence material and said wire mesh into said soil.

2. A silt fence machine as described in claim 1, and including a mechanical means for backfilling some of the soil displaced by said soil disrupter, located behind the wheel and substantially in line with the wheel and soil disrupter.

3. The silt fence machine of claim 1, further including a frame that is attachable to a motive source and supports said soil disrupter, said support structure, said wheel and said mechanical means.

4. The silt fence machine of claim 2, further including a frame that is attachable to a motive source and supports said soil disrupter, said support structure, said wheel and said mechanical means.

5. The silt fence machine of claim 3, wherein the frame contains a stabilizer tending to prevent gravitationally induced articulation of the silt fence machine around the point of its attachment to the motive force.

6. The silt fence machine of claim 5, wherein the stabilizer is interconnected hydraulic pistons whose fluid flow is controllable with a cutoff valve.

7. The silt fence machine of claim 4, wherein the frame contains a stabilizer tending to prevent gravitationally induced articulation of the silt fence machine around the point of its attachment to the motive force.

8. The silt fence machine of claim 7, wherein the stabilizer is interconnected hydraulic pistons whose fluid flow is controllable with a cutoff valve.

9. The silt fence machine of claim 1, wherein the soil disrupter is a rigid plate presenting a forward edge and having a predetermined angle for trenching through said soil at a predetermined, adjustable depth.

10. The silt fence machine of claim 2, wherein the soil disrupter is a rigid plate presenting a forward edge and having a predetermined angle for trenching through said soil at a predetermined, adjustable depth.

11. The silt fence machine of claim 1, wherein the soil disrupter bears a chisel-type point generally at the bottom of said soil disrupter to disrupt said soil.

12. The silt fence machine of claim 2, wherein the soil disrupter bears a chisel-type point generally at the bottom of said soil disrupter to disrupt said soil.

13. The silt fence machine of claim 1, wherein the soil disrupter has a replaceable tip.

14. The silt fence machine of claim 2, wherein the soil disrupter has a replaceable tip.

15. The silt fence machine of claim 1, wherein said support structure supports the silt fence material and wire mesh to dispense said material and wire mesh at substantially the same rate, so that lateral edge portions of both are deposited on the ground behind said soil disrupter and before said wheel, said lateral edge portions generally aligned with an imaginary line between said soil disrupter and wheel.

16. The silt fence machine of claim 2, wherein said support structure supports the silt fence material and wire mesh to dispense said material and wire mesh at substantially the same rate, so that lateral edge portions of both are deposited on the ground behind said soil disrupter and before said wheel, said lateral edge portions generally aligned with an imaginary line between said soil disrupter and wheel.

17. The silt fence machine of claim 15, wherein the frame contains an encumbrance applied to the undispensed silt fence material to prevent inertial dispensation of the silt fence material at a rate different from that of the wire mesh.

18. The silt fence machine of claim 17, wherein the encumbrance is an anchored chain draped over the silt fence material.

19. The silt fence machine of claim 16, wherein the frame contains an encumbrance applied to the undispensed silt fence material to prevent inertial dispensation of the silt fence material at a rate different from that of the wire mesh.

20. The silt fence machine of claim 19, wherein the encumbrance is an anchored chain draped over the silt fence material.

21. The silt fence machine of claim 1, wherein said structure comprises arms generally horizontal to the ground and perpendicular to the line of movement of said motive force to support respective rolls of silt fence material and wire mesh.

22. The silt fence machine of claim 2, wherein said structure comprises arms generally horizontal to the ground and perpendicular to the line of movement of said motive force to support respective rolls of silt fence material and wire mesh.

23. The silt fence machine of claim 21, wherein said arms are rotatable.

24. The silt fence machine of claim 22, wherein said aims are rotatable.

25. The silt fence machine of claim 1, wherein the wheel moving behind the motive forces in frictional engagement with the silt fence material and wire mesh provides the synchronization and dispensing power for taking the silt fence material and wire mesh from said support structure and positioning them for insertion into the soil.

26. The silt fence machine of claim 2, wherein the wheel moving behind the motive forces in frictional engagement with the silt fence material and wire mesh provides the synchronization and dispensing power for taking the silt fence material and wire mesh from said support structure and positioning them for insertion into the soil.

27. The silt fence machine of claim 1, wherein a weight is placed over the silt fence material to maintain tension on the silt fence material as it is dispensed synchronously with the wire mesh.

28. The silt fence machine of claim 2, wherein a weight is placed over the silt fence material to maintain tension on the silt fence material as it is dispensed synchronously with the wire mesh.

29. The silt fence machine of claim 1, wherein said wheel is marked outwardly at predesignated radii from its center point to allow visual determination of the depth the depth of insertion of said wheel into the ground.

30. The silt fence machine of claim 2, wherein said wheel is marked outwardly at predesignated radii from its center point to allow visual determination of the depth the depth of insertion of said wheel into the ground.

31. The silt fence machine of claim 2, wherein the mechanical means is a rigid "foot." positioned rearwardly of and generally in line with said wheel, being vertically adjustable.

32. A method for simultaneously inserting and anchoring silt fence material and wire mesh into the soil, utilizing a silt fence machine having a soil disrupter, a support structure for rolls of silt fence material and wire mesh, and a wheel for embedding silt fence material and wire mesh into the ground, comprising the steps of disrupting the soil with the soil disrupter, dispensing synchronously said silt fence material and said wire mesh in overlapping layers above the disrupted soil, and inserting portions of said overlapping layers into the disrupted soil at a predetermined depth.

33. The method of claim 32 wherein the silt fence machine also has attached thereto a mechanical means for backfilling some of the soil displaced by the soil disruption and wherein there is an additional final step of back-filling the disrupted soil by the mechanical means, about the inserted portions of silt fence material and wire mesh.

* * * * *